US006039636A

United States Patent [19]

Di Nardi

[11] Patent Number: 6,039,636

[45] Date of Patent: Mar. 21, 2000

[54] PRECISION GRINDING OF A PART-SPHERICAL RECESS

[75] Inventor: Peter C. Di Nardi, Livonia, Mich.

[73] Assignee: Ernst Thielenhaus GmbH & Co. KG, Wuppertal, Germany

[21] Appl. No.: 09/110,707

[22] Filed: Jul. 7, 1998

[51] Int. Cl.[7] ..... B24B 7/00

[52] U.S. Cl. ..... 451/178; 451/8; 451/242; 451/246

[58] Field of Search ..... 451/8, 178, 242, 451/246, 913

[56] References Cited

U.S. PATENT DOCUMENTS 2,212,511 8/1940 Conradson ..... 451/913
4,827,675 5/1989 Andrews ..... 451/178

*Primary Examiner*—Timothy V. Eley
*Assistant Examiner*—Willie Berry, Jr.
*Attorney, Agent, or Firm*—Herbert Dubno; Andrew Wilford

[57] ABSTRACT

An apparatus for precision machining a part-spherical recess of a workpiece has a workpiece holder adapted to hold the workpiece which is rotated thereby about a symmetry axis of the recess and a honing tool which is rotated about a tool axis inclined to the workpiece axis while being urged along tool axis against a surface of the recess to hone the surface. In accordance with the invention a spacer body displaceable generally along the workpiece axis is engageable in a use position with the surface and carries a pair of feelers fixed relative to the spacer body. The feelers are in the use position of the spacer body spaced along the workpiece axis from the spacer body, symmetrically diametrally flank the workpiece axis, and engage the surface.

8 Claims, 3 Drawing Sheets

PRECISION GRINDING OF A PART-SPHERICAL RECESS

FIELD OF THE INVENTION

The present invention relates to the precision grinding of a part-spherical recess. More particularly this invention concerns an apparatus for grinding such a recess in a workpiece, for instance a hip-socket prosthesis, and for measuring the size of the recess being ground.

BACKGROUND OF THE INVENTION

In the production of certain workpieces, for example a hip-socket prosthesis, it is necessary to machine a part-spherical recess to a high degree of accuracy. The standard machine for such machining comprises a workpiece holder adapted to hold the workpiece, means for rotating the workpiece holder about a symmetry axis of the recess, a honing tool, and means for rotating the tool about a tool axis inclined to the workpiece axis and for simultaneously urging the tool along the tool axis against a surface of the recess to hone the surface.

To monitor the size of the recess as it is enlarged and trued, the apparatus further has a pair of feelers that symmetrically diametrally flank the workpiece axis and that are engageable with the surface of the recess. In many applications such a system is adequate, but in the machining of a hip-socket prosthesis, where the recess may have a diameter of 20 mm to 40 mm, very little can be tolerated by way of offsize. In fact such a hip-socket prosthesis must be machined to within at most 10 $\mu$m of the desired diameter.

The known diameter gauges are only accurate when the two feelers can be exactly positioned on a diameter of the recess. It is not possible to do this with the known gauges since the tool is occupying or passing through the center of the recess. Thus accurate measurements can only be made when the tool is withdrawn, a procedure that interrupts the machining process and that makes it impossible to continuously monitor recess diameter.

OBJECTS OF THE INVENTION

It is therefore an object of the present invention to provide an improved apparatus for precision machining a part-cylindrical recess of a workpiece.

Another object is the provision of such an improved apparatus for precision machining a part-cylindrical recess of a workpiece which overcomes the above-given disadvantages, that is which accurately measures the recess diameter as it is being machined.

SUMMARY OF THE INVENTION

An apparatus for precision machining a part-spherical recess of a workpiece has according to the invention a workpiece holder adapted to hold the workpiece which is rotated thereby about a symmetry axis of the recess and a honing tool which is rotated about a tool axis inclined to the workpiece axis while being urged along tool axis against a surface of the recess to hone the surface. In accordance with the invention a spacer body displaceable generally along the workpiece axis is engageable in a use position with the surface and carries a pair of feelers fixed relative to the spacer body. The feelers are in the use position of the spacer body spaced along the workpiece axis from the spacer body, symmetrically diametrally flank the workpiece axis, and engage the surface.

Thus the feeler holder lies near the symmetry axis on the workpiece surface and forms a definite reference point for the tips of the feelers. The radius of the part-cylindrical surface is a mathematical function of the spacing of the feelers and of the normally vertical spacing along the workpiece axis of the feeler tips from the holder. Thus the spacing between the feeler tips is directly related to the diameter of the surface being machined, allowing the size of this surface to be monitored with great exactness.

According to the invention the spacer body is formed with a rounded end of a curvature generally equal to that of the recess and engageable with the surface and with a central throughgoing passage through which the tool extends in the use position of the body and when the tool is in engagement with the recess surface. Thus the feelers can be positioned level with and immediately adjacent the honing tool, normally a cylindrically tubular stone, for extremely exact measuring.

The feelers according to the invention are rods having outer ends forming the feeler tips engageable with the surface and inner ends. The spacer body is provided with adjustable mounts holding the inner rod ends. The rods extend generally parallel to each other and to a plane defined by the workpiece and tool axes and the mounts are adjustable to displace the rods away from each other.

Each of the mounts is provided with means for displacing the respective rod perpendicular to the plane. The apparatus includes a controller connected to position sensors in the mounts and to the tool drive for stopping rotation of the tool when the rods reach a predetermined maximum spacing from each other.

The holder is displaceable parallel to the workpiece axis. More particularly the holder is pivotal about a holder axis generally perpendicular to a plane defined by the workpiece and tool axes. This holder axis is spaced from the workpiece axis by a distance equal to several times a radius of curvature the surface so that it is moving virtually parallel to the workpiece axis as the feelers engage the surface.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
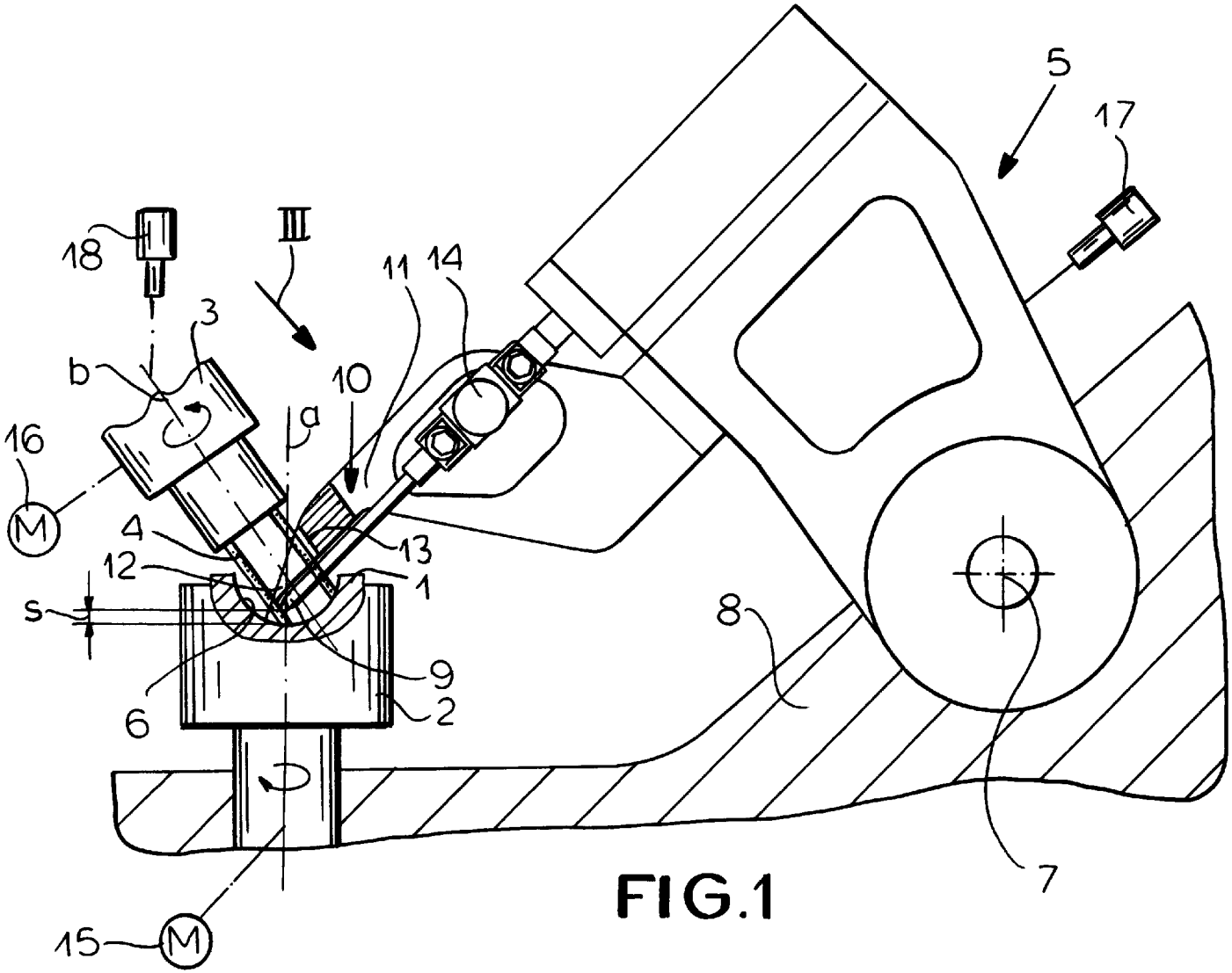
FIG. 1 is a partly sectional and schematic side view of the apparatus according to the invention.

As seen in FIG. 1 a cup-shaped workpiece 1 with a semispherical recess 6 is held in a workpiece holder 2 that is rotated in a fixed support 8 by a motor 15 about a vertical axis a. A tubularly cylindrical honing stone 4 is rotated by a tool holder 3 about an axis b by a motor 16 and can even be displaced axially along this axis b by an actuator shown schematically at 18 so that the end of the tool 4 bears against the surface 6 to enlarge, hone, and true it. The axis b intersects the axis a at an angle of about 45°.

Figure 3:
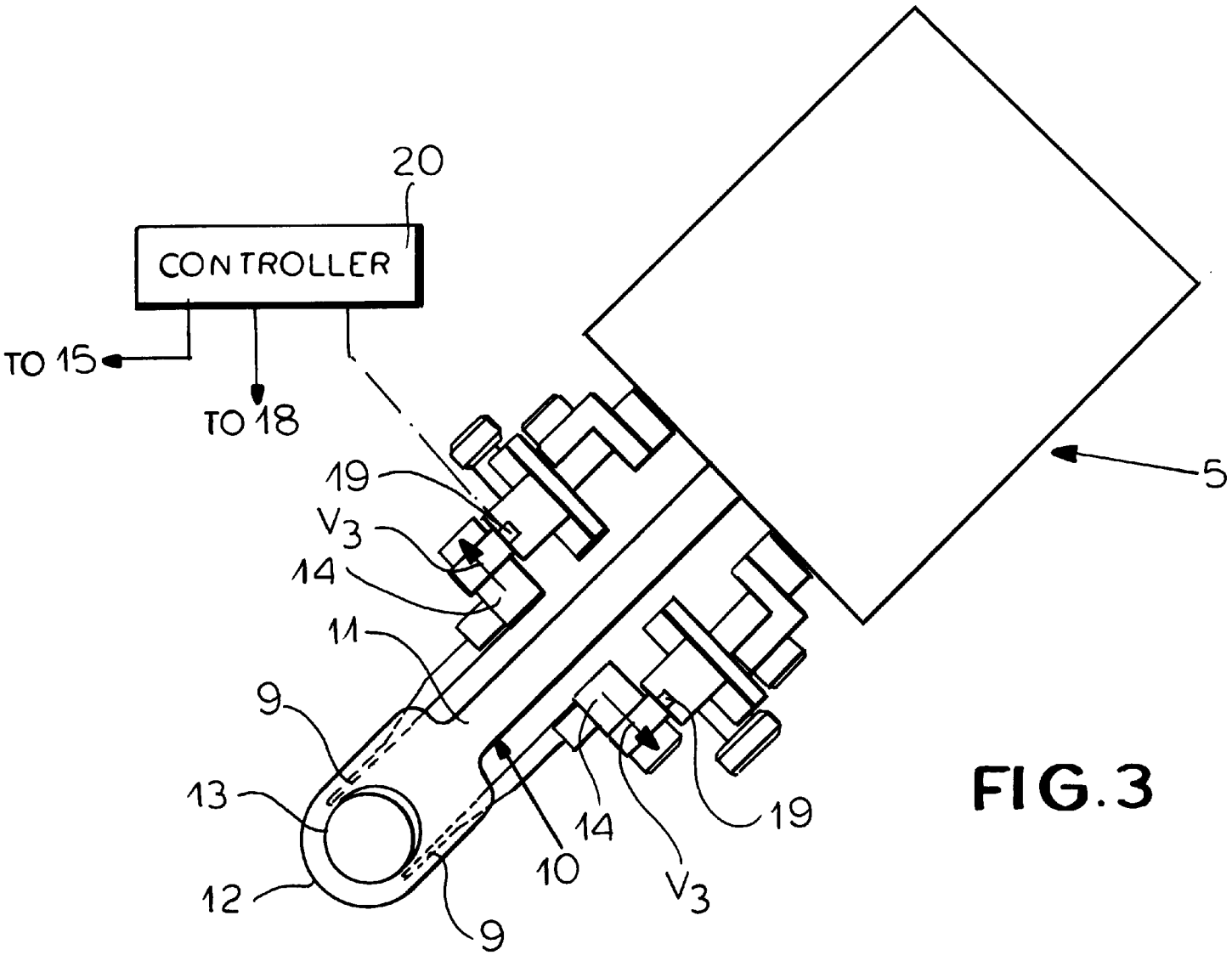
FIG. 3 is a view taken in the direction of arrow III of the tool holder and feelers of this invention.

A gauge head 5 (FIG. 3) carries a spacer body 10 having an arm 11 formed with a rounded end 12 of a curvature generally equal to that of the surface 6 and a central cylindrical hole 13 through which the tool 4 passes during honing as shown in FIG. 1. The entire head 5 can be pivoted about a horizontal axis 7 level with the workpiece 1 by an actuator shown schematically at 17.

According to the invention the head 5 also carries a pair of feeler rods 9 that symmetrically flank the hole 13 and that have inner ends secured in mounts 14 that allow these rods 9 to move in directions indicated by arrows V3 (FIG. 3) perpendicular to a plane defined by the intersecting axes a and b. Each mount 14 is associated with a respective position detector 19 connected to a controller 20 in turn connected to the actuators 17 and 18 and drives 15 and 16.

Figure 2:
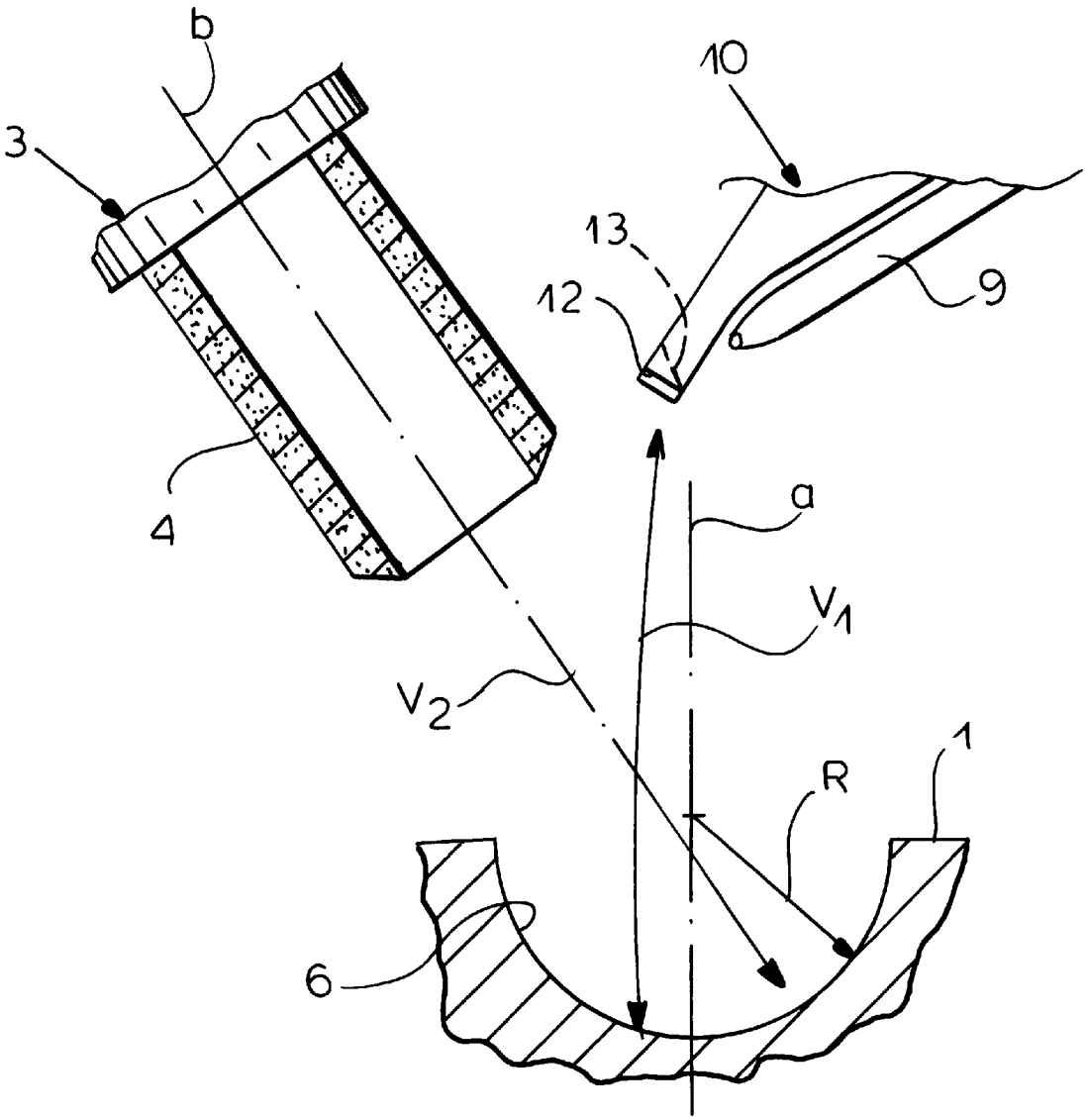
FIG. 2 is a large-scale view of a detail of FIG. 1.

As shown in FIG. 2, to machine a workpiece the head 5 is first pivoted about its axis 7 to move the spacer 10 along a line $V_1$ virtually parallel to the axis a. Then the actuator 18 moves the tool 4 along its axis b as shown by arrow $V_2$ and the end of the tool 4 is pressed against the surface 6 as the tool 4 is rotated by the motor 16 and the workpiece 1 is rotated by the motor 15. This action hones the part-spherical surface 6 to a radius R.

Meanwhile the tips of the rods 9 are in engagement with the surface 6 and are urged apart in direction $V_3$ by the mounts 14. Once the sensors 19 detect that they are in a position corresponding to the desired radius R, machining is stopped.

I claim:

1. An apparatus for precision machining a part-spherical recess of a workpiece centered on a workpiece axis, the apparatus comprising:

a workpiece holder adapted to hold the workpiece;

means for rotating the workpiece holder about a symmetry axis of the recess;

a honing tool;

means for rotating the tool about a tool axis inclined to the workpiece axis and for simultaneously urging the tool along the tool axis against a surface of the recess to hone the surface;

a spacer body displaceable generally along the workpiece axis and engageable in a use position with the surface; and a pair of feelers mounted on the spacer body and having in the use position of the spacer body tips that are spaced along the workpiece axis from the spacer body, and symmetrically diametrally flank the workpiece axis, and engage the surface.

2. The precision-machining apparatus defined in claim 1 wherein the spacer body is formed with a rounded end of a curvature generally equal to a curvature of the surface of the recess and engageable with the surface and with a central throughgoing passage through which the tool extends in the use position of the body and when the tool is in engagement with the recess surface.

3. The precision-machining apparatus defined in claim 1 wherein the feelers are respective rods having outer ends forming the tips engageable with the surface and inner ends, the spacer body being provided with adjustable mounts holding the inner rod ends.

4. The precision-machining apparatus defined in claim 3 wherein the rods extend generally parallel to each other and to a plane defined by the workpiece and tool axes, the mounts being adjustable to displace the rods away from each other.

5. The precision-machining apparatus defined in claim 3 wherein each of the mounts is provided with means for displacing the respective rod perpendicular to the plane, the apparatus including control means connected to t he mounts and to the tool-rotating means for stopping rotation of the tool when the rods reach a predetermined maximum spacing from each other.

6. The precision-machining apparatus defined in claim 1 wherein the holder is displaceable parallel to the workpiece axis.

7. The precision-machining apparatus defined in claim 1 wherein the holder is pivotal about a holder axis generally perpendicular to a plane defined by the workpiece and tool axes.

8. The precision-machining apparatus defined in claim 7 wherein the holder axis is spaced from the workpiece axis by a distance equal to at least three times a radius of curvature of the surface.

* * * * *